US005676813A

United States Patent [19]

Nakamura et al.

[11] Patent Number: 5,676,813

[45] Date of Patent: Oct. 14, 1997

[54] METHOD FOR FILM FORMATION

[75] Inventors: Shigeru Nakamura; Yutaka Mizutani; Terukazu Shibata; Toru Ozaki, all of Nishikamo-gun, Japan

[73] Assignee: Kansai Paint Co., Ltd., Japan

[21] Appl. No.: 588,914

[22] Filed: Jan. 19, 1996

[30] Foreign Application Priority Data

Jan. 20, 1995 [JP] Japan ..... 7-024607

[51] Int. Cl.[6] ..... C23C 28/00; B05D 7/14

[52] U.S. Cl. ..... 205/50; 204/488; 205/198; 427/379; 427/388.2; 427/409; 428/416; 428/457

[58] Field of Search ..... 204/484, 486, 204/487, 488; 205/50, 198; 427/379, 386, 388.1, 388.2, 409, 410; 428/416, 457

[56] References Cited

U.S. PATENT DOCUMENTS

| | | | |
|---|---|---|---|
| 5,075,165 | 12/1991 | Kishi et al. | 428/331 |
| 5,385,656 | 1/1995 | Duebler et al. | 204/181.1 |
| 5,432,005 | 7/1995 | Tahigami et al. | 428/414 |

FOREIGN PATENT DOCUMENTS

0402181A1 12/1990 European Pat. Off. .

*Primary Examiner*—Kathryn L. Gorgos
*Assistant Examiner*—William T. Leader
*Attorney, Agent, or Firm*—Wenderoth, Lind & Ponack

[57] ABSTRACT

The present invention provides a method for film formation, which comprises applying onto a substrate an electrocoating (A) and an intermediate coating (B) in this order, heat-curing the formed films of the coatings (A) and (B), applying thereon a liquid deep color coating (C) which comprises 100 parts by weight of a thermosetting resin composition, 0.1–30 parts by weight of an aluminum powder having an average particle diameter of 10μ or less, 1–100 parts by weight of a titanium oxide pigment and 0.1–10 parts by weight of a carbon black pigment and which shows a film hiding power of 25μ or less and a film elongation ratio of 10–50% at 20° C., a liquid color clear coating (D) which comprises a thermosetting resin composition and a color pigment as the main components and which shows a film hiding power of 50μ or more and a film elongation ratio of 10% or less at 20° C., and a clear coating (E) in this order on a wet-on-wet basis, and heating the formed films of the coatings (C), (D) and (E) to crosslink and cure the three films simultaneously. According to the method, part of the heat-curing steps employed in multilayer film formation can be eliminated and a multilayer film of smaller thickness and improved properties (e.g. improved surface smoothness and chipping resistance) can be obtained.

21 Claims, No Drawings

METHOD FOR FILM FORMATION

The present invention relates to a method for formation of a multilayer film comprising an electrocoating film, an intermediate coating film, a color coating film, a color clear coating film and a clear coating film and having a glittering appearance. More particularly, the present invention relates to a method for formation of a multilayer film, in which method part of the heat-curing steps employed in multilayer film formation can be eliminated and which method can give a multilayer film of smaller thickness and improved properties (e.g. improved surface smoothness and chipping resistance).

It is known to form a multilayer film by applying, on a substrate, an electrocoating and an intermediate coating, heat-curing the formed films, applying thereon a color coating, heat-curing the formed film, applying thereon a color clear coating and a clear coating on a wet-on wet basis, and heat-curing the formed films. In the thus-formed multilayer film, light passes through the clear coating film and the color clear coating film, and the hue of the color coating film provides beautiful color tone together with the decorativeness of the color clear coating film.

In the above known method for formation of multilayer film, however, it has been necessary to (1) form the color coating film in a thickness (as cured) of generally 30μ or more in order to hide the sublayer film and (2) heat-cure the color coating film before the next coating (the color clear coating) is applied, to prevent the intermixing between the color coating film and the color clear coating film formed thereon; moreover, the resulting multilayer film is not sufficient in chipping resistance, surface smoothness, etc.; thus, improvements have been desired.

The present inventors made a study aiming at (1) improving, in the above method for formation of multilayer film, the hiding power of the color coating film to make smaller the thickness of the film, (2) preventing the intermixing between the color coating film and the color clear coating film and eliminating the step of heat-curing the color coating film, and (3) making smaller the total thickness of the multilayer film formed. As a result, it was found out that the above aims can be attained by using, as the color coating, a deep color coating capable of forming a soft film, comprising an aluminum powder of particular particle diameter, a titanium oxide pigment and a carbon black pigment and, as the color clear coating, a coating capable of forming a hard film. It was also found out that by formulating the color coating and the color clear coating so as to each show a particular film elongation ratio, the resulting multi-layer film can have improved properties (e.g. improved chipping resistance and surface smoothness). The present invention has been completed based on the above findings.

The present invention provides a method for film formation, which comprises applying onto a substrate an electrocoating (A) and an intermediate coating (B) in this order, heat-curing the formed films of the coatings (A) and (B), applying thereon a liquid deep color coating (C) which comprises 100 parts by weight of a thermosetting resin composition, 0.1–30 parts by weight of an aluminum powder having an average particle diameter of 10μ or less, 1–100 parts by weight of a titanium oxide pigment and 0.1–10 parts by weight of a carbon black pigment and which shows a film hiding power of 25μ or less and a film elongation ratio of 10–50% at 20° C., a liquid color clear coating (D) which comprises a thermosetting resin composition and a color pigment as the main components and which shows a film hiding power of 50μ or more and a film elongation ratio of 10% or less at 20° C., and a clear coating (E) in this order on a wet-on-wet basis, and heating the formed films of the coatings (C), (D) and (E) to crosslink and cure the three films simultaneously.

The method for film formation according to the present invention is hereinafter described in detail.

Electrocoating (A)

Any of a cationic electrocoating and an anionic electrocoating can be used. However, a cationic electrocoating is generally preferred in view of the corrosion resistance.

The cationic electrocoating can be a per se known cationic electrocoating obtained by adding, as necessary, a crosslinking agent, a pigment and other additives to an aqueous solution or dispersion of a salt of a cationizable group-containing polymeric substance. The cationizable group-containing polymeric substance includes, for example, those substances obtained by modifying a base resin (e.g. an acrylic resin or an epoxy resin) with an amino compound or the like to introduce a cationizable group into the base resin. By neutralizing the cationizable group-containing polymeric substance with an acid such as organic acid, inorganic acid or the like, an aqueous solution or dispersion can be obtained. As the crosslinking agent, a blocked polyisocyanate compound, an alicyclic epoxy resin or the like can be preferably used.

Into a bath of the cationic electrocoating is immersed a metallic substrate (a material to be coated) (e.g. an automobile body) (the substrate acts as a cathode), and an electric current is passed between the cathode and an anode under ordinary conditions to apply the electrocoating onto the substrate. The thickness of the resulting electrocoating film can be determined as desired depending upon the application purpose but preferably is generally 10–30μ, particularly 15–25μ as cured. The electrocoating film can be crosslinked and cured by heating generally at a temperature of 140°–200° C. for about 10–40 minutes. In the present invention, while the electrocoating film is in an uncrosslinked state, an intermediate coating (B) may be applied thereon; however, it is generally preferable that the intermediate coating (B) is applied after the electrocoating film has been crosslinked and cured.

Intermediate coating (B)

This is a coating applied on the film of the electrocoating (A). It can be a per se known liquid coating composition comprising a thermosetting resin composition and a solvent as the main components and, as necessary, a coloring pigment, an extender pigment and other additives for coating. The intermediate coating (B) serves to endow the finally obtained multilayer film with improved smoothness, distinctness of image gloss, luster, etc.

Specific examples of the thermosetting resin composition used in the intermediate coating (B) are those compositions obtaining by adding, to a base resin such as acrylic resin, polyester resin, alkyd resin or the like, having a crosslinkable functional group such as hydroxyl group or the like, a crosslinking agent such as melamine resin, urea resin, blocked or unblocked polyisocyanate compound or the like, The solvent includes an organic solvent and/or water.

The intermediate coating (B) can be applied on the crosslinked and cured film or uncured film of the electrocoating (A) by electrostatic coating, air spraying, airless spraying or the like. The preferable thickness of the film of the intermediate coating (B) is generally 10–50μ, particularly 20–40μ as cured. The film can be crosslinked and cured by heating generally at a temperature of 100°–170° C. for about 10–40 minutes. In the present invention, after the film of the intermediate coating (B) has been crosslinked and cured, a deep color coating (C) is applied.

Deep color coating (C)

The deep color coating (C) is applied on the crosslinked and cured film of the intermediate coating (B) and is a liquid coating composition which comprises 100 parts by weight of a thermosetting resin composition, 0.1–30 parts by weight of an aluminum powder having an average particle diameter of 10μ or less, 1–100 parts by weight of a titanium oxide pigment and 0.1–10 parts by weight of a carbon black pigment and which shows, in a crosslinked and cured film state, a film hiding power of 25μ or less and a film elongation ratio of 10–50% at 20° C.

The coating (C) is characterized by comprising three components, i.e. an aluminum powder, a titanium oxide pigment and a carbon black pigment. As a result, the film of the coating (C) has an excellent hiding power and can sufficiently hide the sublayer (the intermediate coating film) in a thin thickness (as cured) of 25μ or less and, depending upon the contents of the aluminum powder, the titanium oxide pigment and the carbon black pigment, 5–20μ, particularly 8–15μ; moreover, there occurs substantially no intermixing between the uncured film of the coating (C) and a color clear coating (D) applied thereon on a wet-on-wet basis.

The thermosetting resin composition used in the deep color coating (C) is preferably a composition comprising a base resin such as acrylic resin, polyester resin, alkyd resin or the like, having a crosslinkable functional group such as hydroxyl group or the like and a crosslinking agent such as amino resin (e.g. melamine resin or urea resin) or the like.

Herein, "film elongation ratio" referred to for the deep color coating (C) is a value obtained when the measurement was made for a film formed by heat-curing the above-mentioned thermosetting resin composition alone. The film elongation ratio is specifically obtained by dissolving or dispersing the thermosetting resin composition in an appropriate solvent, coating the solution or dispersion on a tinplate sheet in a film thickness of 15μ as cured, heat-curing the resulting film at 140° C. for 30 minutes, separating the cured film by a mercury amalgamation method, cutting the separated film into a rectangular test piece of 20 mm (length)×5 mm (width), and subjecting the test piece to a tensile test at a tensile speed of 20 mm/min at 20° C. using a universal tensile tester with a constant temperature bath (Autograph S-D, a product of Shimadzu Corporation) until the test piece is ruptured.

In the present invention, the deep color coating (C) has a film elongation ratio of 10–50%, preferably 15–40%, more preferably 20–35% at 20° C. When the film elongation ratio deviates from this range, the resulting multilayer film generally has reduced chipping resistance, smoothness, impact resistance, etc. The film elongation ratio can be easily controlled by changing the kinds, proportions, etc. of the basic resin and crosslinking agent used in the coating (C).

The aluminum powder used in the deep color coating (C) has an average particle diameter in lengthwise direction, of 10μ or less, preferably 3–7μ and a thickness of preferably 0.01–1μ, particularly preferably 0.05–0.8μ. When the average particle diameter in lengthwise direction is more than 10μ, the resulting film has a reduced hiding powder. Herein, "average particle diameter" is a median diameter obtained by a laser diffraction scattering method using LA-500 (trade name) produced by Horiba, Ltd. (the same applies also hereinafter).

The aluminum powder is preferably a fine powder of metallic aluminum, and the particle surfaces may be treated with a silane coupling agent or the like.

The titanium oxide pigment can be one per se known as a pigment for coating. It preferably has an average particle diameter of 5μ or less, particularly 2μ or less. The surface of the titanium oxide pigment may be treated with alumina, silica or the like.

The carbon black pigment can also be one per se known as a pigment for coating. It preferably has an average particle diameter of 1μ or less, particularly 0.8μ or less.

The proportions of the aluminum powder, the titanium oxide pigment and the carbon black pigment can be 0.1–30 parts by weight, preferably 0.5–20 parts by weight, more preferably 1–5 parts by weight (the aluminum powder), 1–100 parts by weight, preferably 5–60 parts by weight, more preferably 5–30 parts by weight (the titanium oxide pigment), and 0.1–10 parts by weight, preferably 0.1–5 parts by weight, more preferably 1–4 parts by weight (the carbon black pigment), per 100 parts by weight (as solid content) of the thermosetting resin composition.

In the deep color coating (C), it is requisite to use the aluminum powder, the titanium oxide pigment and the carbon black pigment in combination. The total amount of these three pigments is selected so that the film of the deep color coating (C) has a hiding power of 25μ or less as cured.

In the present specification, "hiding power" refers to a minimum film thickness in which the color of the sublayer cannot be recognized with naked eyes. It is specifically a minimum film thickness in which when a film is formed on a black-and-white-checkered substrate and visual observation is made from above the film, the black and white color of the substrate is unrecognizable. In the present invention, by using the three kinds of pigments in combination in the deep color coating (C), it has become possible to form the film of coating (C) in a small thickness, i.e. a hiding powder of 25μ or less.

The deep color coating (C) can be prepared by dispersing the above-mentioned components in a solvent, for example, an organic solvent and/or water.

The film formed with the deep color coating (C) comprising such components, preferably has a hue of 30 or less, particularly 5–25, more particularly 10–20 in terms of L value in Lab color system. As long as a film of such a deep color is formed, the coating (C) can further comprise, as necessary, other color pigment, a metallic pigment, an extender pigment, etc.

In the present invention, the deep color coating (C) is applied on the crosslinked and cured film of the intermediate coating (B) preferably in a film thickness of 6–25μ, particularly 7–20μ, more particularly 8–15μ as cured by electrostatic coating, air spraying, airless spraying or the like. The thus-formed film of the deep color coating (C) generally shows no glittering appearance. In the present invention, it is preferable that the film of the deep color coating (C) is dried at room temperature or at an elevated temperature (100° C. or less is preferable) without crosslinking and curing it and then a color clear coating (D) is applied thereon.

Color clear coating (D)

The color clear coating (D) forms a colored transparent film and is applied on the uncured film of the deep color coating (C). It is a liquid coating composition which is composed mainly of a thermosetting resin composition and a color pigment and which shows, in its crosslinked and cured film state, a film hiding power of 50μ or more and a film elongation ratio of 10% or less at 20° C.

The film of the color clear coating (D) can have various hues. Further, the film has a small hiding power and therefore the hue of the sublayer, i.e. the film of the deep color coating (C) can be seen therethrough.

The thermosetting resin composition is preferably a composition comprising a base resin such as acrylic resin, polyester resin, alkyd resin or the like, having a crosslinkable functional group such as hydroxy group or like and a crosslinking agent such as amino resin (e.g. melamine resin or urea resin) or the like.

The film elongation ratio of the color clear coating (D) is 10% or less, preferably 8% or less, more preferably 7% or less at 20° C. The "film elongation ratio" is a value obtained when the heat-cured film of the thermosetting resin composition alone has been tested in the same manner as mentioned with respect to the deep color coating (C). That is, the film elongation ratio is obtained by coating the thermosetting resin composition on a tinplate sheet in a film thickness of 15μ as cured, crosslinking and curing the resulting film at 140° C. for 30 minutes, separating the crosslinked and cured film by a mercury amalgamation method, cutting the separated film into a rectangular test piece of 20 mm (length)×5 mm (width), and subjecting the test piece to a tensile test at a tensile speed of 20 mm/min at 20° C. using a universal tensile tester with a controlled temperature bath (Autograph S-D, a product of Shimadzu Corporation) until the test piece is ruptured. When the elongation ratio of the film of the color clear coating (D) is larger than 10% at 20° C., the resulting multilayer film generally shows reduced finish appearance, luster, resistance to swelling by solvents, etc.

The color pigment used in the color clear coating (D), preferably has an average particle diameter of 1μ or less. It includes, for example, organic or inorganic color pigments such as titanium oxide of fine particles, perylene and iron oxide. The amount of the color pigment used is not particularly restricted but preferably is generally 0.1–10 parts by weight, particularly 0.1–8 parts by weight, more particularly 0.1–7 parts by weight per 100 parts by weight of the thermosetting resin composition.

The film hiding power of the color clear coating (D) must be 50μ or more, preferably 70μ or more, more preferably 90μ or more. When the film hiding power is smaller than 50μ, the decorativeness, particularly the transparency of the film is low. The hiding power can be controlled by the kind, amount, etc. of the color pigment used.

The color clear coating (D) can be obtained by mixing or dispersing the above-mentioned components with or in a solvent, for example, an organic solvent and/or water.

The color clear coating (D) is applied on the uncrosslinked and uncured film of the deep color coating (C) preferably by electrostatic coating, air spraying, airless spraying or the like in a film thickness of 5–30μ, particularly 8–20μ, more particularly 10–15μ as crosslinked and cured. At this time, there occurs no intermixing between the uncrosslinked and uncured film of the deep color coating (C) and the film of the color clear coating (D) applied thereon. In the present invention, the film of the color clear coating (D) is dried as necessary at room temperature or at an elevated temperature (a temperature not higher than 100° C. is preferred) without crosslinking and curing the film (the film is substantially in an uncured state), and then a clear coating (E) is applied thereon.

Clear coating (E)

The clear coating (E) is applied on the uncured film of the color clear coating (D), is a liquid coating composition comprising a thermosetting resin composition and a solvent, and can form a transparent film.

The thermosetting resin composition includes, for example, a composition comprising a base resin such as acrylic resin, polyester resin, alkyd resin or the like, having a crosslinkable functional group such as hydroxyl group or like and a crosslinking agent such as amino resin (e.g. melamine resin or urea resin), polyisocyanate compound or the like. As the thermosetting resin composition, there can also be preferably used a thermosetting resin composition which need not contain any crosslinking agent such as amino resin (e.g. melamine resin or urea resin) or the like, such as described in, for example, Japanese Patent Application Kokai (Laid-Open) Nos. 84132/1987, 39653/1989 and 258526/1991, U.S. Pat. Nos. 4,650,718, 4,703,101, 4,881,811, 4,772,672, 4,895,910, 5,026,793, 5,284,919, 5,389,727 and 5,274,045, EP-A-353734 and 559186.

As the solvent, an organic solvent and/or water can be used. The clear coating (E) can be prepared by dissolving or dispersing the thermosetting resin composition in the solvent. The clear coating (E) basically contains no color pigment.

The clear coating (E) is applied on the uncured film of the color clear coating (D) preferably by electrostatic coating, air spraying, airless spraying or the like in a film thickness of 15–50μ, particularly 20–45μ, more particularly 25–40μ as cured.

In the present method for film formation, a multilayer film can be obtained by applying, on a substrate, the electrocoating (A) and the intermediate coating (B) in this order, heat-curing the resulting films of the coatings (A) and (B), applying thereon the deep color coating (C), the color clear coating (D) and the clear coating (E) in this order on a wet-on-wet basis, and heating the resulting films of the coatings (C), (D) and (E) to cure the films simultaneously. The preferable temperature used for curing the films of the coatings (C), (D) and (E) simultaneously is generally 100°–180° C., particularly 120°–160° C.

The present method for film formation can provide the following effects.

(1) Since there occurs no intermixing when the color clear coating (D) is directly applied on the uncured film of the deep color coating (C), part of the heating steps can be eliminated.

(2) Since the deep color coating (C) shows an excellent film hiding power, the total thickness of the multilayer film formed can be made smaller.

(3) The multilayer film formed has improved properties (e.g. improved smoothness and chipping resistance).

Thus, the method for film formation according to the present invention can be favorably used for coating of automobile body, household electric appliances, etc. all made of a metal or a plastic.

The present invention is hereinafter described more concretely by way of Examples and Comparative Examples.

I. Samples (1) Cationic electrocoating (A)

ELECRON 9400 HB (a trade name, a product of Kansai Paint Co. Ltd., an epoxy resin-blocked polyisocyanate compound type).

(2) Intermediate coating (B)

TP-37 PRIMER SURFACER (a trade name, a product of Kansai Paint Co., Ltd., a polyester resin-melamine resin type, an organic solvent type).

(3) Deep color coatings (C)

Organic solvent type coatings obtained by mixing a polyester resin, a melamine resin, an aluminum powder, a titanium oxide pigment, a carbon black pigment and other pigments in the proportions shown in Table 1. In Table 1, the amount of each component is shown in a solid content ratio. The hue of each film formed with these deep color coatings is 20 or less in terms of L value in Lab color system.

TABLE 1

| | Deep color coating (C) | | | | |
|---|---|---|---|---|---|
| | C-1 | C-2 | C-3 | C-4 | C-5 |
| Polyester resin*1 | 65 | 70 | 75 | 70 | 70 |
| Melamine resin*2 | 35 | 30 | 25 | 30 | 30 |
| Fine aluminum powder*3 | 1 | 1 | 1 | — | 1 |
| Titanium oxide pigment*4 | 5 | 5 | 5 | 5 | — |
| Carbon black*5 | 4 | 4 | 4 | — | 1 |
| Iron oxide pigment*6 | 2 | 2 | 2 | 2 | 2 |
| Organic red pignent 1*7 | 10 | 10 | 10 | 10 | 10 |
| Elongation ratio (%)*8 | 25 | 30 | 35 | 30 | 30 |
| Hiding power (μ)*9 | 15 | 15 | 15 | 100< | 50< |

*1A phthalic anhydride/hexahydrophthalic anhydride type polyester resin (number-average molecular weight = about 4,000, hydroxyl value = 82, acid value = 7).
*2U-Van 28-60 (a product of MITSUI TOATSU CHEMICALS, INC.
*3K-9800 (a product of Asahi Chemical Industry Co., Ltd., average particle diameter = 5–6μ, thickness = 0.05–0.8μ).
*4Titanium JR 701 (a product of TEIKOKU KAKO CO., LTD., average particle diameter = 0.3–0.6μ).
*5Carbon FW 200 (a product of DEGUSSA Co., particle diameters = 0.8μ or more).
*6KNO-W Iron Oxide (a product of Toda Kogyo Corp., average particle diameter = 0.2–0.5μ).
*7Chromofine Red 6820 (a product of Dainichiseika Color & Chemicals Mfg. Co., Ltd.).
*8A polyester resin (*1) and a melamine resin were mixed in the above proportions and dissolve& in an organic solvent (toluene/xylene = 1/1 by weight ratio). The solution was coated on a tinplate sheet in a film thickness of 15μ as cured, and then heat-cured at 140° C. for 30 minutes. The cured film was separated by an mercury amalgamation method and cut into a test sample of 20 mm (length) × 5 mm (width). The test sample was subjected to a tensile test at 20° C. at a tensile speed of 20 mm/min using a universal tensile tester with a constant temperature bath (Autograph S-D, a product of Shimadzu Corporation), and an elongation ratio (%) was measured when the test sample was ruptured.
*9Coating films were formed on a black-and-white-checkered substrate of checkered pattern, in various film thicknesses. A minimum film thickness (μ) when the black and white colors could not be distinguished with naked eyes, was measured.

(4) Color clear coatings (D)

Organic solvent type coatings obtained by mixing an acrylic resin, a melamine resin and organic color pigments in the proportions shown in Table 2. In Table 2, the amount of each component is shown in a solid content ratio.

TABLE 2

| | Color Clear coating (D) | | | | |
|---|---|---|---|---|---|
| | D-1 | D-2 | D-3 | D-4 | D-5 |
| Acrylic resin*10 | 65 | 70 | 75 | 70 | 70 |
| Melamine resin*11 | 35 | 30 | 25 | 30 | 30 |
| Organic red Pigment*7 | 2 | 2 | 2 | — | 15 |
| Organic red pigment*12 | 2 | 2 | 2 | — | 15 |
| Elongation ratio (%)*8 | 2 | 5 | 7 | 5 | 2 |
| Hiding power (μ)*9 | 100< | 100< | 100< | 100< | 30 |

*10A methyl methacrylate type acrylic resin having a number-average molecular weight of about 2,000, a hydroxyl value of 70 and an acid value of 8.
*11U-Van 28-60 (a product of MITSUI TOATSU CHEMICALS, INC.).
*12Irgazin Dpp Red BO (a product of Ciba-Geigy Co).

(5) Clear coating (E)

MAGICRON CLEAR (a trade name, a product of Kansai Paint Co., Ltd., an acrylic resin-melamine resin type, an organic solvent type).

II. Examples and Comparative Examples

The above-mentioned samples were applied and heat-cured according to the coating steps shown in Table 3, to form multilayer films. The films were tested for performances and the results are shown also in Table 3.

TABLE 3

| | | Examples | | | Comparative Examples | | | |
|---|---|---|---|---|---|---|---|---|
| | | 1 | 2 | 3 | 1 | 2 | 3 | 4 |
| Electro-coating | Symbol | (A) | | | | | | |
| | Heating conditions | 170° C. × 30 min | | | | | | |
| Inter-mediate coating | Symbol | (B) | | | | | | |
| | Heating conditions | 160° C. × 30 min | | | | | | |
| Deep color coating | Symbol | C-1 | C-2 | C-3 | C-4 | C-5 | C-1 | C-2 |
| | Drying conditions | Room temp. × 5 min | | | | | | |
| Color clear coating | Symbol | D-1 | D-2 | D-3 | D-1 | D-2 | D-4 | D-5 |
| | Drying conditions | Room temp. × 5 min | | | | | | |
| Clear coating | Symbol | (E) | | | | | | |
| | Heating conditions | 140° C. × 30 min | | | | | | |
| Performance test results | | | | | | | | |
| Smoothness | | ○ | ○ | ○ | X | Δ | ○ | Δ |
| Chipping resistance | | ○ | ○ | ○ | ○ | ○ | ○ | ○ |
| Finish appearance | | ○ | ○ | ○ | X | Δ | ○ | Δ |
| Transparency | | ○ | ○ | ○ | Δ | Δ | X | X |

On a degreased and zinc phosphate-treated steel plate was electrocoated, by an ordinary method, the cationic electrocoating (A) so as to give a film of 20μ in thickness as cured (hereinafter, thickness refers to thickness as cured). The coated cationic electrocoating (A) was heated at 170° C. for 30 minutes for curing. On the cured film of the cationic electrocoating (A) was coated the intermediate coating (B) so as to give a film of 30μ in thickness. The coated intermediate coating (B) was heated at 140° C. for 30 minutes for curing.

On the cured film of the intermediate coating (B) was coated one of the deep color coatings (C-1) to (C-5) by the use of a minibell type rotary static electrocoating machine under the conditions of discharge amount=150 cc, 50,000 rpm, shaping pressure=1 kg/cm$^2$, gun distance=30 cm, booth temperature=20° C. and booth humidity=75%. The film thickness of the deep color coating (C) was 10–15μ.

The resulting plate was allowed to stand in the booth for 5 minutes. Then, on the uncured film of the deep color coating (C) was coated one of the color clear coatings (D-1) to (D-5) by the use of an REA gun under the conditions of discharge amount=180 cc, atomization pressure=2.7 kg/cm$^2$, pattern pressure=3.0 kg/cm$^2$, gun distance=30 cm, booth temperature=20° C. and booth humidity=75%. The film thickness of the color clear coating (D) was 10–15μ.

The resulting plate was allowed to stand in the booth for 5 minutes. On the uncured film of the color clear coating (D) was coated the clear coating (E) by the use of a minibell type rotary static electrocoating machine under the conditions of discharge amount=300 cc, 40,000 rpm, shaping pressure=5 kg/cm$^2$, gun distance=30 cm, booth temperature=20° C. and booth humidity=75%. The film thickness of the clear coating (E) was 45–50μ.

The resulting plate was allowed to stand in a room for 3 minutes and then heated at 140° C. for 30 minutes in a dryer of hot air circulation type to subject the three-layered film of the deep color coating (C), the color clear coating (D) and the clear coating (E) to simultaneous curing. The performance of each resulting multilayer film was measured and rated as follows.

Smoothness

Rated visually according to the following yardstick.

○: Good Δ: Slight surface roughening ×: Striking surface roughening

Chipping resistance

Measured using a gravelometer and 100 g of No. 7 crushed stones under the conditions of air pressure=4.5 kg/cm$^2$ and angle=45°. Rated visually according to the following yardstick.

○: Slight scar caused by impact was seen on part of the clear coating film.

Finish appearance

The color development of color pigments was examined visually and rated according to the following yardstick.

○: Color development is good. Δ: Color development is marginally good. ×: Color development is poor.

Transparency

Rated visually according to the following yardstick.

○: Good. Δ: Marginally good. ×: Poor.

What is claimed is:

1. A method for film formation, which comprises applying onto a substrate an electrocoating (A) and an intermediate coating (B) in this order, heat-curing the formed films of the coatings (A) and (B), applying thereon a liquid deep color coating (C) which comprises 100 parts by weight as solid content of a thermosetting resin composition, 0.1–30 parts by weight of an aluminum powder having an average particle diameter of 10μ or less, 1–100 parts by weight of a titanium oxide pigment and 0.1–10 parts by weight of a carbon black pigment and which shows a film hiding power of 25μ or less and a film elongation ratio of 10–50% at 20° C., a liquid color clear coating (D) which comprises a thermosetting resin composition and a color pigment and which shows a film hiding power of 50μ or more and a film elongation ratio of 10% or less at 20° C., and a clear coating (E) in this order on a wet-on-wet basis, and heating the formed films of the coatings (C), (D) and (E) to crosslink and cure the three films simultaneously, and wherein the deep color coating (C) forms a deep color film having an L value of 30 or less in the Lab color system.

2. The method according to claim 1, wherein the electrocoating (A) is a cationic electrocoating.

3. The method according to claim 1, wherein the film of the electrocoating (A) has a thickness of 10–30μ as cured.

4. The method according to claim 1, wherein the intermediate coating (B) is applied after the film of the electrocoating (A) has been cross linked and cured.

5. The method according to claim 1, wherein the intermediate coating (B) comprises a thermosetting resin composition and a solvent.

6. The method according to claim 1, wherein the film of the intermediate coating (B) has a thickness of 10–50μ as cured.

7. The method according to claim 1, wherein the film of the deep color coating (C) shows an elongation ratio of 15–40% at 20° C.

8. The method according to claim 1, wherein the aluminum powder in the deep color coating (C) has an average particle diameter of 3–7μ in the particle lengthwise direction and a thickness of 0.01–1μ.

9. The method according to claim 1, wherein the titanium oxide pigment has an average particle diameter of 5μ or less.

10. The method according to claim 1, wherein the deep color coating (C) is a liquid coating composition comprising 100 parts by weight as solid content of a thermosetting resin composition, 0.5–20 parts by weight of an aluminum powder, 5–80 parts by weight of a titanium oxide pigment and 0.1–5 parts by weight of a carbon black pigment.

11. The method according to claim 1, wherein the deep color coating (C) is a liquid coating composition comprising 100 parts by weight as solid content of a thermosetting resin composition, 1–5 parts by weight of an aluminum powder, 5–30 parts by weight of a titanium oxide pigment and 1–4 parts by weight of a carbon black pigment.

12. The method according to claim 1, wherein the deep color coating (C) is a liquid coating composition comprising 100 parts by weight as solid content of a thermosetting resin composition, 1–5 parts by weight of an aluminum powder, 10–30 parts by weight of a titanium oxide pigment and 1–4 parts by weight of a carbon black pigment.

13. The method according to claim 1, wherein the film of the deep color coating (C) has a thickness of 6–25μ as cured.

14. The method according to claim 1, wherein the color clear coating (D) shows a film elongation ratio of 8% or less at 20° C.

15. The method according to claim 1, wherein the color pigment in the color clear coating (D) has an average particle diameter of 1μ or less.

16. The method according to claim 1, wherein the color clear coating (D) is a liquid coating composition comprising 100 parts by weight of a thermosetting resin composition and 0.1–10 parts by weight of a color pigment.

17. The method according to claim 1, wherein the color clear coating (D) is a liquid coating composition comprising 100 parts by weight of a thermosetting resin composition and 0.1–7 parts by weight of a color pigment.

18. The method according to claim 1, wherein the film of the color clear coating (D) has a thickness of 10–15μ as cured.

19. The method according to claim 1, wherein the film of the clear coating (E) has a thickness of 20–40μ as cured.

20. The method according to claim 1, wherein the films of the coatings (C), (D) and (E) are heated at a temperature of 100°–180° C. to crosslink and cure the films simultaneously.

21. A coated article obtained by the method of claim 1.

* * * * *